US010006193B1

(12) United States Patent
Liu et al.

(10) Patent No.: US 10,006,193 B1
(45) Date of Patent: Jun. 26, 2018

(54) LIGHTWEIGHT STEEL CONSTRUCTION

(71) Applicants: Tai Yu Liu, Taichung (TW); Feng Chyi Do, Taoyuan (TW)

(72) Inventors: Tai Yu Liu, Taichung (TW); Feng Chyi Do, Taoyuan (TW)

( * ) Notice: Subject to any disclaimer, the term of this patent is extended or adjusted under 35 U.S.C. 154(b) by 0 days. days.

(21) Appl. No.: 15/426,534

(22) Filed: Feb. 7, 2017

(51) Int. Cl.

| | |
|---|---|
| ***E04B 1/19*** | (2006.01) |
| ***E04B 1/24*** | (2006.01) |
| ***E04B 7/02*** | (2006.01) |
| ***E04B 5/10*** | (2006.01) |
| ***E04C 3/04*** | (2006.01) |
| ***E04C 3/32*** | (2006.01) |

(52) U.S. Cl.
CPC ..... *E04B 1/1912* (2013.01); *E04B 1/2403* (2013.01); *E04B 5/10* (2013.01); *E04B 7/022* (2013.01); *E04C 3/04* (2013.01); *E04C 3/32* (2013.01); *E04B 2001/199* (2013.01); *E04B 2001/1915* (2013.01); *E04B 2001/1963* (2013.01); *E04B 2001/249* (2013.01); *E04B 2001/2448* (2013.01); *E04B 2103/06* (2013.01)

(58) Field of Classification Search
CPC ..... E04B 1/1912; E04B 5/10; E04B 7/022; E04B 1/2403; E04B 2001/249; E04B 2001/2448; E04B 2001/199; E04B 2001/1963; E04B 2103/06; E04B 2001/1915; E04C 3/32; E04C 3/04
See application file for complete search history.

(56) References Cited

U.S. PATENT DOCUMENTS

| | | | | |
|---|---|---|---|---|
| 1,818,418 | A * | 8/1931 | Millard | E04B 1/24 52/263 |
| 4,964,256 | A * | 10/1990 | McCracken | B21D 47/01 29/897.34 |
| 5,625,997 | A * | 5/1997 | Callahan | E04B 2/766 52/834 |
| 7,155,874 | B2 * | 1/2007 | Lee | E04B 1/24 52/843 |
| 9,803,365 | B2 * | 10/2017 | Peltier | E04C 3/09 |
| 2017/0096823 | A1 * | 4/2017 | Apostolopoulos | E01D 22/00 |
| 2017/0145679 | A1 * | 5/2017 | Upfal | E04B 1/2403 |
| 2017/0204597 | A1 * | 7/2017 | McDonald | E04B 1/19 |

FOREIGN PATENT DOCUMENTS

| | | | | |
|---|---|---|---|---|
| CA | 2376645 | A1 * | 12/2000 | E04C 3/08 |
| EP | 0864702 | A1 * | 9/1998 | E04B 1/24 |
| FR | 2965037 | A3 * | 3/2012 | E04B 1/24 |
| KR | 20030079993 | A * | 10/2003 | E04B 1/2403 |

* cited by examiner

*Primary Examiner* — Babajide A Demuren
(74) *Attorney, Agent, or Firm* — C. G. Mersereau; Nikolai & Mersereau, P.A.

(57) ABSTRACT

A lightweight steel construction includes a plurality of beams and rafters. Each of the beams includes two opposite C-shaped steels. Two ends of the two C-shaped steels are respectively positioned by two first positioning members in a length direction of the C-shaped steels. Several beams can be assembled with each other via the first positioning members to be formed as a crossbeam and a column of a building. Each of the rafters includes a C-shaped steel. Two ends of the C-shaped steel are respectively positioned by two second positioning members in the length direction of the C-shaped steel. Several rafters can be positioned between adjacent beams via the second positioned members to be formed as a floor surface, a wall surface, and a roof of the supporting frame of the building.

6 Claims, 8 Drawing Sheets

LIGHTWEIGHT STEEL CONSTRUCTION

BACKGROUND OF THE INVENTION

Field of the Invention

The present invention relates to constructions of buildings, in particular to a lightweight steel construction made by C-shaped steels.

Description of the Prior Art

Because the concern on environmental protection becomes popular, industries have their own ways to avoid pollution, greenhouse effect, and global warming for achieving a target with minimum produced wastes and minimum consumed resources. Taking architecture industries as an example, most economical construction materials and structures are targeted in premise of achieving requirements on structural strength, as known as green architectures. Lightweight steel constructions are one of the green architectures. Because the lightweight steel constructions have features of safety, environmental-friendly concern, high efficiency, lightweight components, and so on, lightweight steel constructions are developed rapidly. For example, in US, there were 120,000 buildings with such requirements in 1998. Regarding Japan, after the Hanshin earthquake in 1995, developments and researches in lightweight steel construction technologies and related construction specifications become faster. In addition, in Japan, related measures are also established to allow such technology being suitable to be applied in Japan. Technologies about the lightweight steel constructions benefit the whole Japan. Moreover, the technologies are also introduced into Taiwan in recent years.

In general, C-shaped steels are the main components of the lightweight steel construction. The C-shaped steels can be formed as various crossbeams, columns, or rafters. In conventional, these crossbeams, columns, or rafters are combined with each other by soldering. However, such soldering requires processional welders and high quality soldering techniques, leading higher costs. In addition, the C-shaped steels are treated by metal plating or zinc coating to be anti-rust, yet soldering would damage the anti-rust coating, making the construction be prone to be rusted. As a result, soldering is not recommended as a proper way for combining the C-shaped steels. Therefore, some manufacturers have developed components to combine the C-shaped steels by locking. For example, related techniques are described in TW patent number 437782, 514089, 590134, 590135, M276067, M297972, and M314222. However, it is difficult to have a basic backbone of a building by combining the C-shaped steels with the conventional components. In addition, the conventional components are insufficient in structural strength and convenience.

SUMMARY OF THE INVENTION

One object of the present invention is to provide a lightweight steel construction in which positioning members are positioned with two ends of C-shaped steel(s) to form crossbeams, columns, or rafters. Then, any two of the aforementioned components are further connected with each other by the positioning members. Therefore, the C-shaped steels can be formed as the basic backbone of a building by locking in a fast and convenient manner.

Another object of the present invention is that, the first positioning members in a unitary structure can not only be combined with two C-shaped steels to form a crossbeam or a column in rectangular tubular shaped, but also provided as connection members between crossbeams or columns. Therefore, the assembling of the construction is very convenient.

Yet another object of the present invention is that, the second positioning members in a unitary structure can be combined with a C-shaped steel and an adjacent crossbeam (or column). Therefore, the supporting backbone of the floor surface, the wall surface, and the roof of the building can be assembled rapidly and conveniently.

Still yet another object of the present invention is that, the first positioning members and the second positioning members are positioned on end surfaces of the two ends of the crossbeam (or the column, or the rafter), a surface angle of the end surface of the crossbeam (or the column, or the rafter) can be adjusted for constructing an inclined roof or eaves. Therefore, constructing the roof of the building can be more convenient.

A further object of the present invention is that, the two C-shaped steels are combined with each other to form a beam in rectangular tubular shaped by the first positioning members, and the first positioning member has the wire hole. Therefore, cables or wires can be inserted into the interior of the beam through the wire hole and protected by the C-shaped steels. In addition, a separation gap between the two C-shaped steels of the beam can be provided for ventilation and heat insulation.

A further another object of the present invention is that, two ends of the beam (or the rafter) have the positioning members. Therefore, the building can have modified or added construction in an easy manner.

In view of these objects, the present invention provides a lightweight steel construction comprising:

at least two first positioning members respectively positioned on two ends of two opposite C-shaped steels in a length direction of the C-shaped steels to form a beam in rectangular tubular shaped, the first positioning members respectively form combination points on two end surfaces of the beam, several beams are combined with each other via the combination points and formed as crossbeams and columns of a building; and at least two second positioning members respectively positioned on two ends of a C-shaped steel in the length direction of the C-shaped steel to form a rafter, the second positioning members respectively form assembling points on two end surfaces of the rafter, several rafters are positioned between adjacent beams via the assembling points and formed as a floor surface, a wall surface, and a roof of the building.

Wherein, each of the C-shaped steels of the beam has a front plate, two side plates at two sides of the front plate, and two flanges respectively extending toward each other from free sides of the side plates. An opening is formed between the two flanges. Each of the first positioning members has a first bottom surface and first sidewalls respectively extending from four edges of the first bottom surface in a same direction. The first sidewalls of the first positioning members are locked with the front plates and the corresponding side plates of the C-shaped steels to form the beam by locking members. The first bottom surfaces of the first positioning members are respectively located on the end surfaces of the beam to form the combination points, so that the several beams are combined with each other via locking members and formed as the crossbeams and columns of the building.

In addition, the C-shaped steel of the rafter has a front plate, two side plates at two sides of the front plate, and two flanges respectively extending toward each other from free sides of the side plates. An opening is formed between the two flanges for disposing the second positioning member. Each of the second positioning members has a second bottom surface and second sidewalls respectively extending from three connected edges of the second bottom surface in a same direction. The second sidewalls of the second positioning members are locked with the front plate and the side plates of the C-shaped steel to form the rafter by locking members. The second bottom surfaces of the second positioning members are respectively located on the end surfaces of the rafter to form the assembling points and the second bottom surface has several through holes, so that two ends of each of the rafters are assembled between adjacent beams via the through holes and the locking members, and the rafters are formed as the floor surface, the wall surface, and the roof of the building.

In one embodiment, two opposite first sidewalls of the first sidewalls of the first positioning member respectively have a notch and a baffle plate between the notches, the notches are for the insertion of the flanges of the C-shaped steel, the baffle plate is for the limitation the flanges of the C-shaped steel, so that two separation gaps are respectively formed on two opposite sides of the beam.

In one embodiment, a wire hole is on a center of the first bottom surface of the first positioning member.

In one embodiment, the locking member comprises an insert nut and a bolt.

DETAIL PORTIONED DESCRIPTION OF THE PREFERRED EMBODIMENTS

Figure 1:
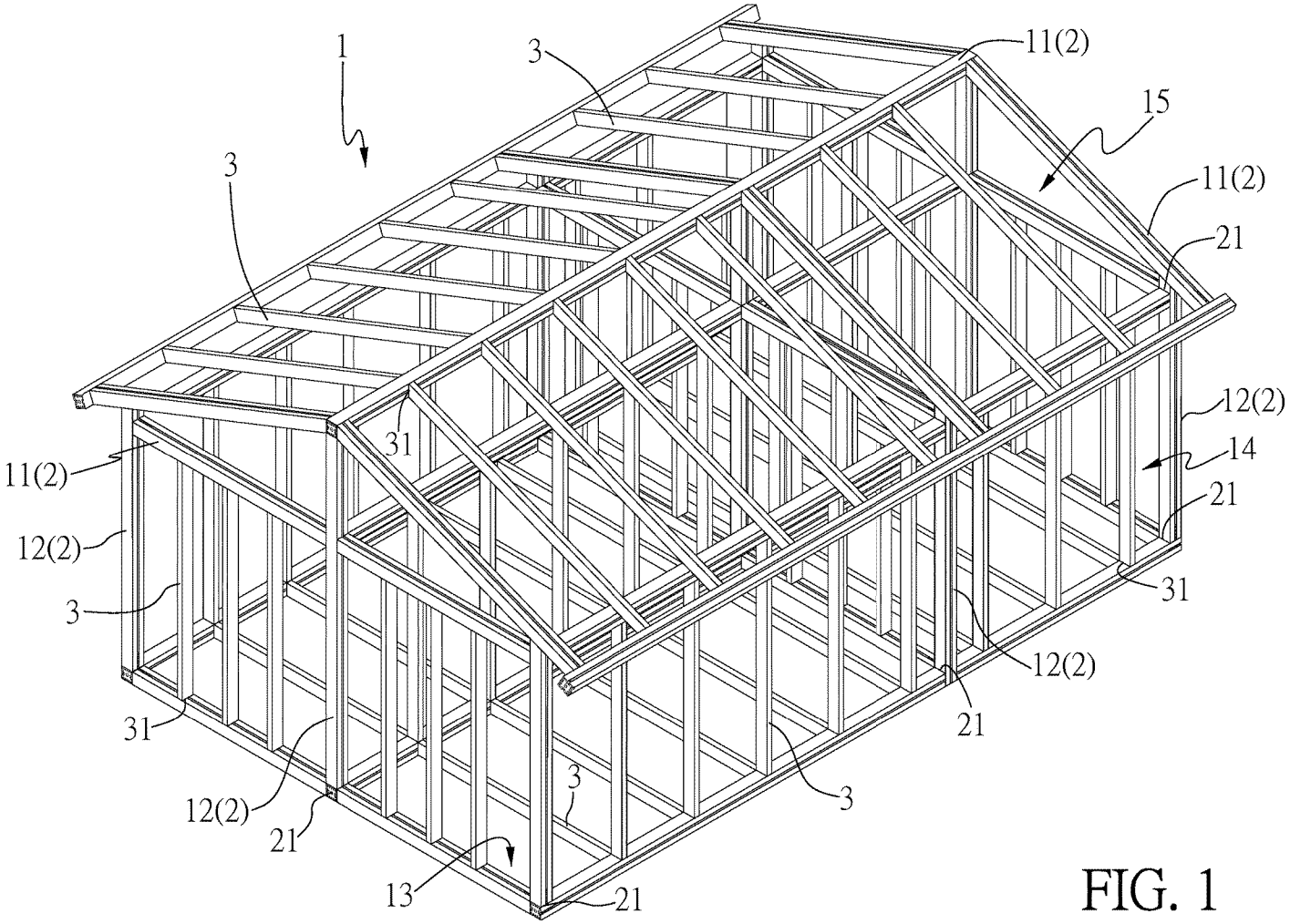
FIG. 1 illustrates an exemplary schematic view of a building formed by beams and rafters according to the present invention.
Figure 2:
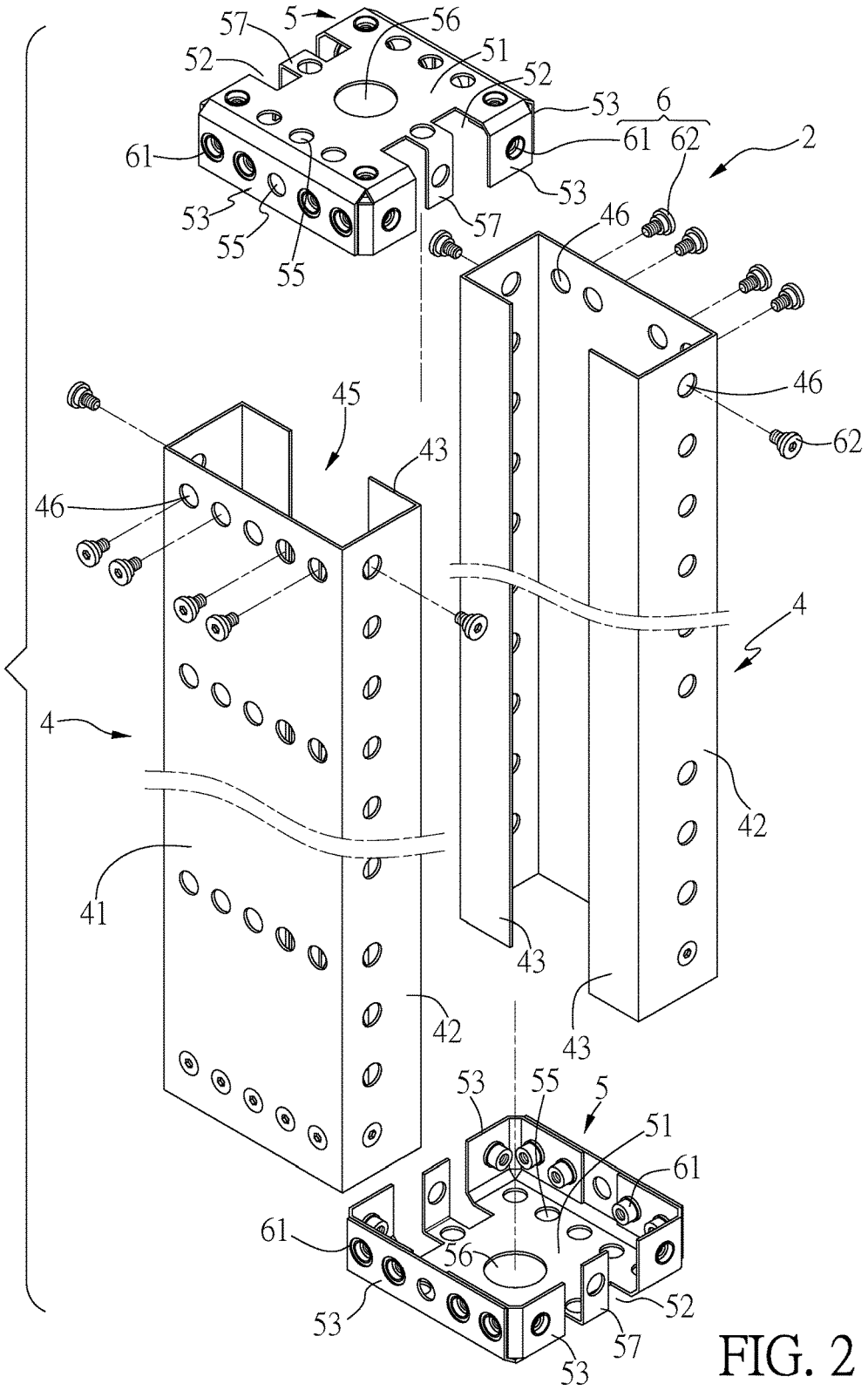
FIG. 2 illustrates an exploded view of a beam according to the present invention.
Figure 3:
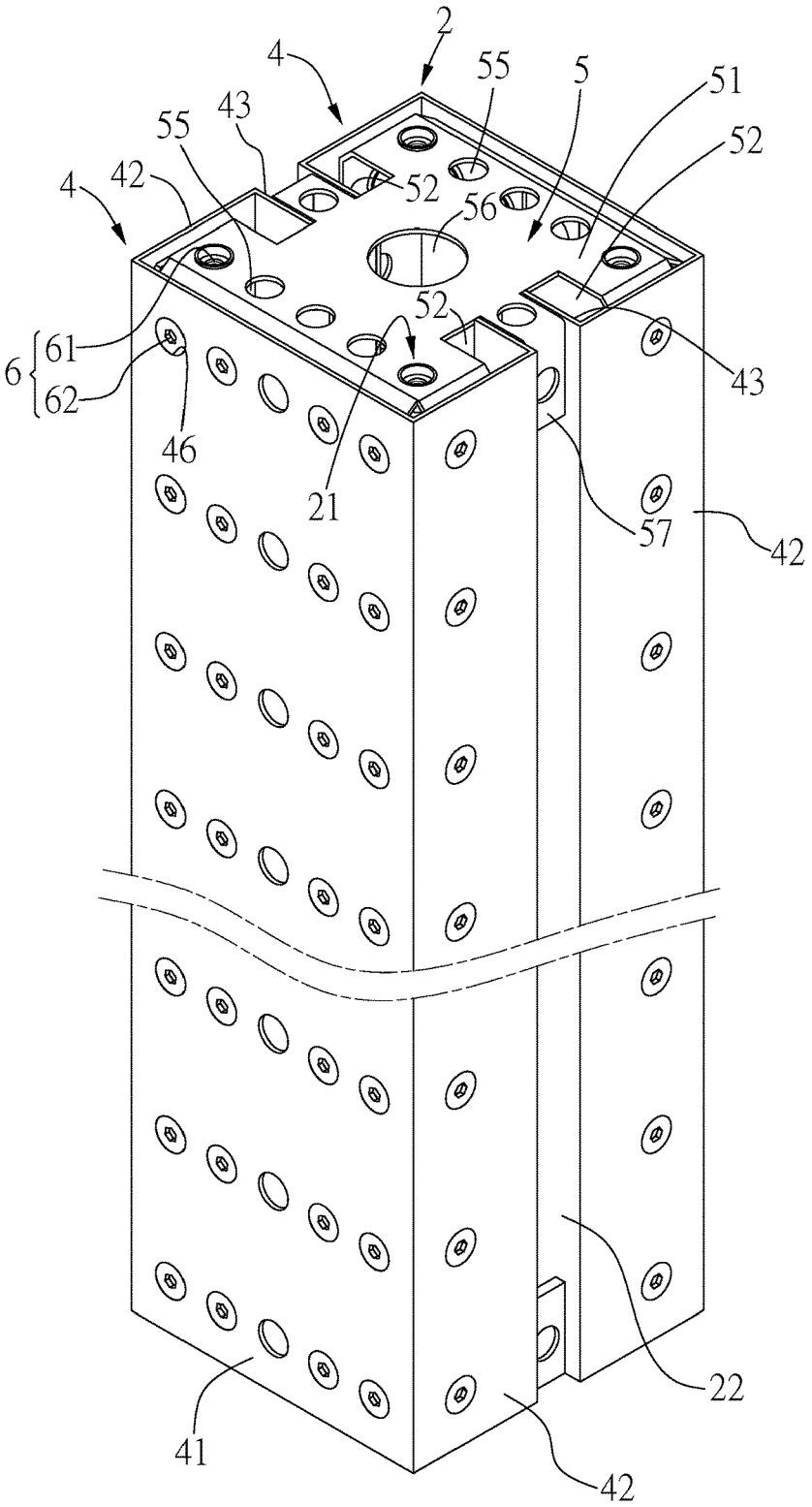
FIG. 3 illustrates a perspective view of the beam according to the present invention.
Figure 4:
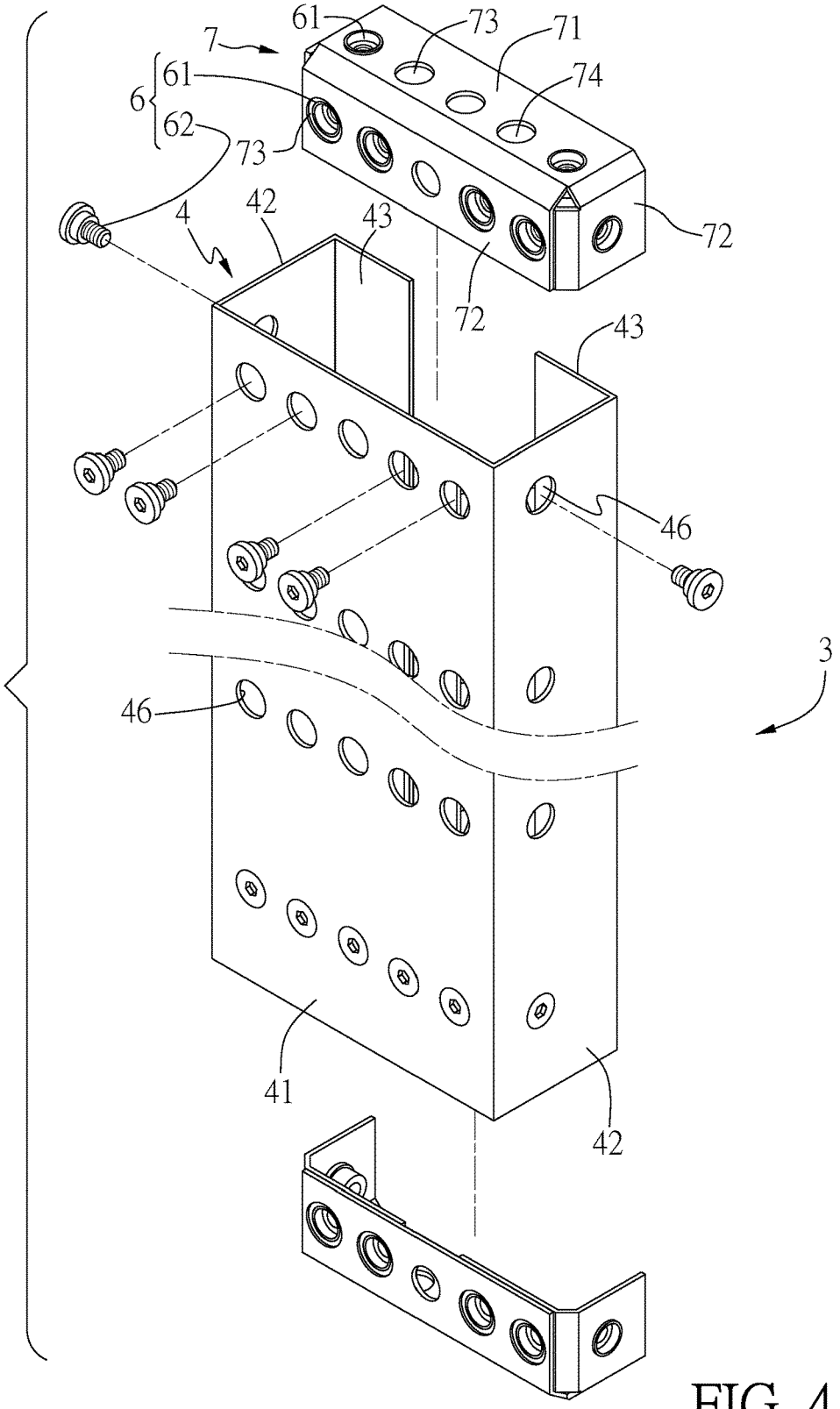
FIG. 4 illustrates an exploded view of a rafter according to the present invention.
Figure 5:
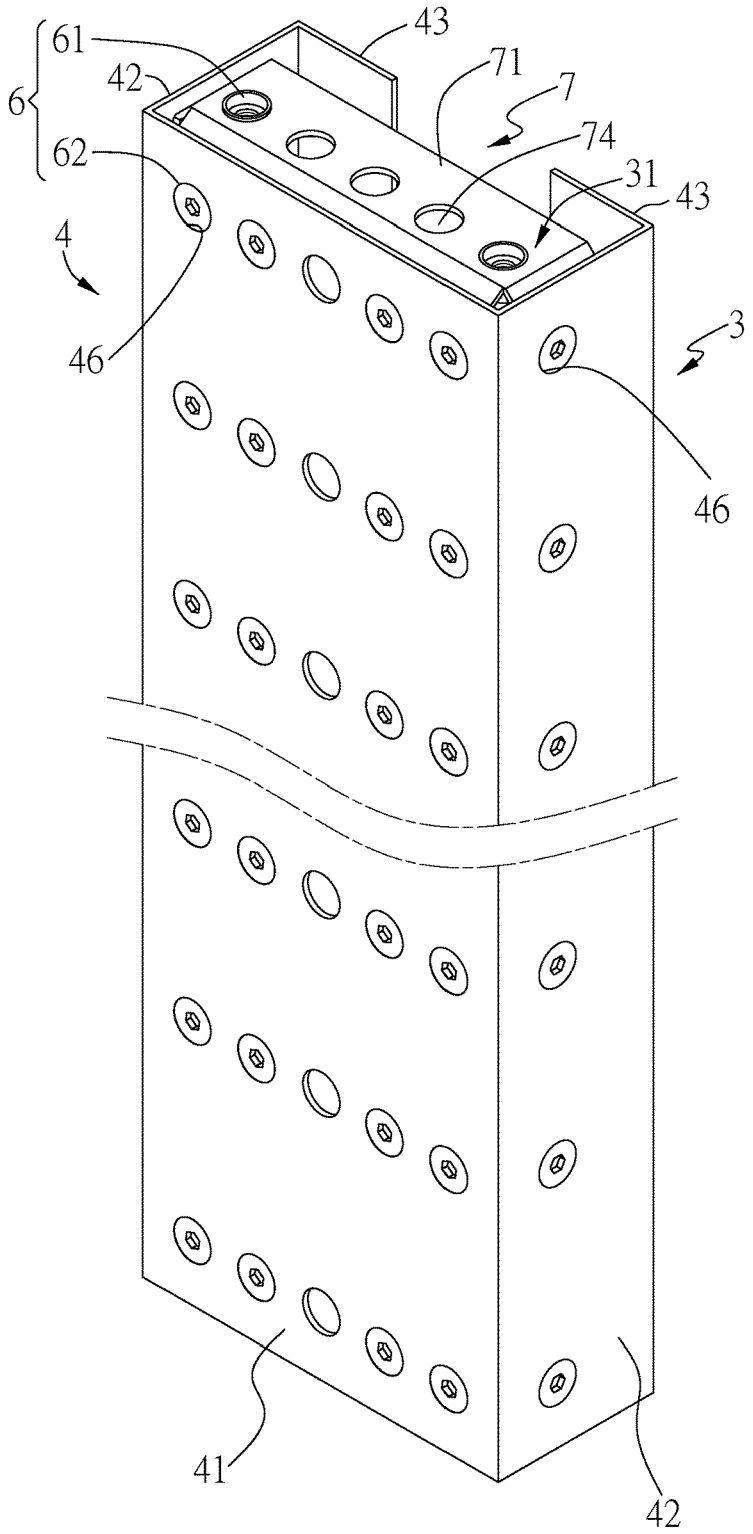
FIG. 5 illustrates a perspective view of the rafter according to the present invention.

Please refer to FIGS. 1 to 5. FIG. 1 illustrates a lightweight steel construction according to the present invention. FIG. 1 is for illustrative purpose, not a limitation to the present invention. The building 1 comprises a plurality of beams 2 and rafters 3. Wherein, the beams 2 are assembled with each other to form crossbeams 11 and columns 12 of the building 1. The rafter 3 is assembled between the crossbeam 11 and the column 12, the rafter 3 is provided as the supporting frame of a seal plate, and the rafter 3 can be formed as a floor surface 13, a wall surface 14, or a roof 15 of the building 1.

Here, the beam 2 comprises two C-shaped steels 4 and at least two first positioning members 5. Wherein, the C-shaped steel 4 has a front plate 41, two side plates 42 at two sides of the front plate 41, and two flanges 43 respectively extending toward each other from free sides of the side plates 42. An opening 45 is formed between the two flanges 43. The first positioning member 5 has a first bottom surface 51 in rectangular shaped and first sidewalls 53 respectively extending from four edges of the first bottom surface 51 in a same direction. In assembling, the openings 45 of the two C-shaped steels 4 are opposite to each other. Next, the two first positioning members 5 are respectively positioned with two ends of the two C-shaped steels 4 in a length direction of the C-shaped steels 4. Therefore, the first sidewalls 53 of the first positioning member 5 respectively correspond to the front plates 41 and the side plates 42 of the two C-shaped steels 4. In addition, two opposite first sidewalls 53 of the first sidewalls 53 respectively have a notch 52 and a baffle plate 57 between the notches 52. The notches 52 and the baffle plate 57 correspond to the flanges 43 of the C-shaped steels 4. The notches 52 are for the insertion of the flanges 43 of the C-shaped steels 4, the baffle plate 57 is for the limitation of the flanges 43 of the C-shaped steels 4, so that two separation gaps 22 are respectively formed on two opposite sides of the two opposite C-shaped steels 4. Then, the first sidewalls 53 of the first positioning members 5 are locked with the front plates 41 and the corresponding side plates 42 of the C-shaped steels 4 by several locking members 6 to form the beam 2 in rectangular tubular shaped. Hence, the first bottom surface 51 of the first positioning member 5 is located at the end surface of the beam 2 to form a combination point 21 for combining with other beams 2. Therefore, several beams 2 are combined with each other via the combination points 21 and several locking members 6 and formed as the crossbeams 11 and the columns 12 of the building 1.

When the beam 2 has a longer length, several first positioning members 5 may be locked on proper portions between the two ends of the two C-shaped steels 4 in the length direction of the C-shaped steels 4. Therefore, the beam 2 can have bamboo joint structures to improve the structural strength of the beam 2. Accordingly, the supporting performance of the crossbeams 11 and the columns 12 formed by the beams 2 can be improved.

Furthermore, a wire hole 56 is on a center of the first bottom surface 51 of the first positioning member 5. Therefore, electric cables, network cables, or telephone wires can be inserted into the wire hole 56 and received in the crossbeams 11 or the columns 12. Accordingly, the crossbeams 11 and the columns 12 can not only have a beautiful appearance but also can protect the wires and cables.

The rafter 3 comprises a C-shaped steel 4 and at least two second positioning members 7. Wherein, the structure of the C-shaped steel 4 for forming the rafter 3 is the same as that of the C-shaped steel 4 for forming the beam 2. The second positioning member 7 has a second bottom surface 71 and second sidewalls 72 respectively extending from three connected edges of the second bottom surface 71 in a same direction. The second sidewalls 72 of the second positioning member 7 are locked with the front plate 41 and the side plates 42 of the C-shaped steels 4 by several locking members 6 to form the rafter 3. The second bottom surface 71 of the second positioning member 7 is located at the end surface of the rafter 3 to form an assembling point 31.

Therefore, two ends of each of the rafters 3 can be assembled between adjacent beams 2. Accordingly, the rafters 3 can be provided as the supporting frame of the floor surface 13, the wall surface 14, and the roof 15 of the building 1.

In this embodiment, the locking member 6 is an assembly of an insert nut 61 and a bolt 62. In operation, holes 46, 55, 73 are opened on the C-shaped steels 4, the first positioning members 5, and the second positioning members 7. Then, the insert nuts 61 are properly positioned in the holes 46, 55, 73. Next, the bolts 62 are inserted into the insert nuts 61 and positioned with the insert nuts 61.

Accordingly, upon assembling the building 1, the number and the size of the C-shaped steels 4 as well as the number of the first positioning member 5 and that of the second positioning member 7 can be computed in advance according to the construction of the building 1. Therefore, these components can be manufactured in the factory and then transported to the construction site.

Figure 6:
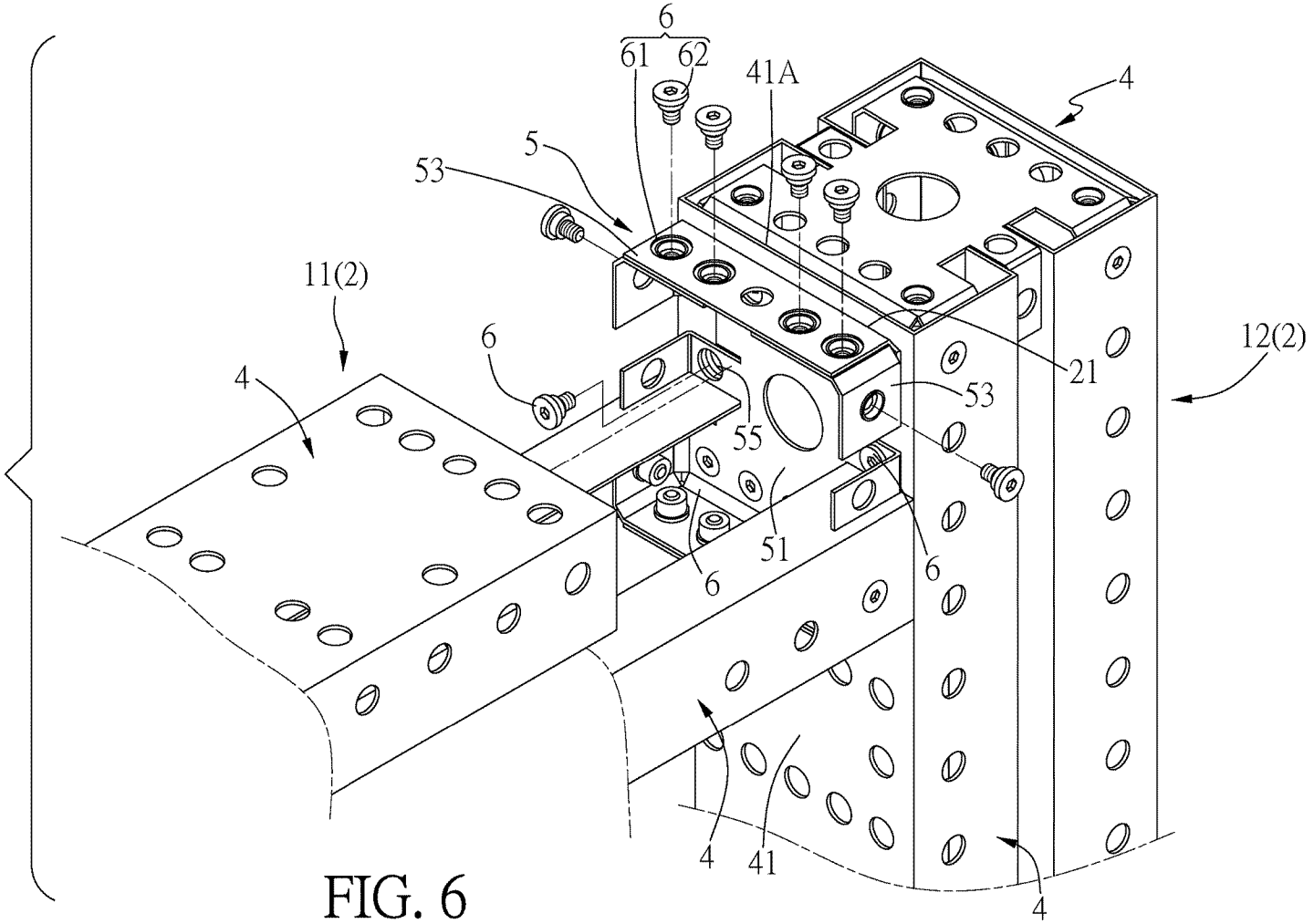
FIG. 6 illustrates a schematic exploded view showing the beams are to be assembled with each other to form crossbeams and columns of the building according to the present invention.

At the construction site, several beams 2 are combined with each other via the combination points 21 formed on the first bottom surfaces 51 of the first positioning members 5 and formed as the crossbeams 11 and the columns 12 of the construction of the building 1. In detail, FIG. 6 illustrates a schematic exploded view showing a crossbeam 11 is to be assembled with a column 12. As shown, the front plate 41 of one of the C-shaped steels 4 of a standing beam 2 is locked with the first bottom surface 51 of the first positioning member 5 of a laid beam 2 by locking members 6, and the two C-shaped steels 4 of the laid beam 2 are locked on the first sidewall 53 of the first positioning member 5 by locking members 6. Accordingly, the standing beam 2 and the laid beam 2 can be assembled with each other to be formed as the crossbeam 11 and the column 12 of the building 1.

Figure 7:
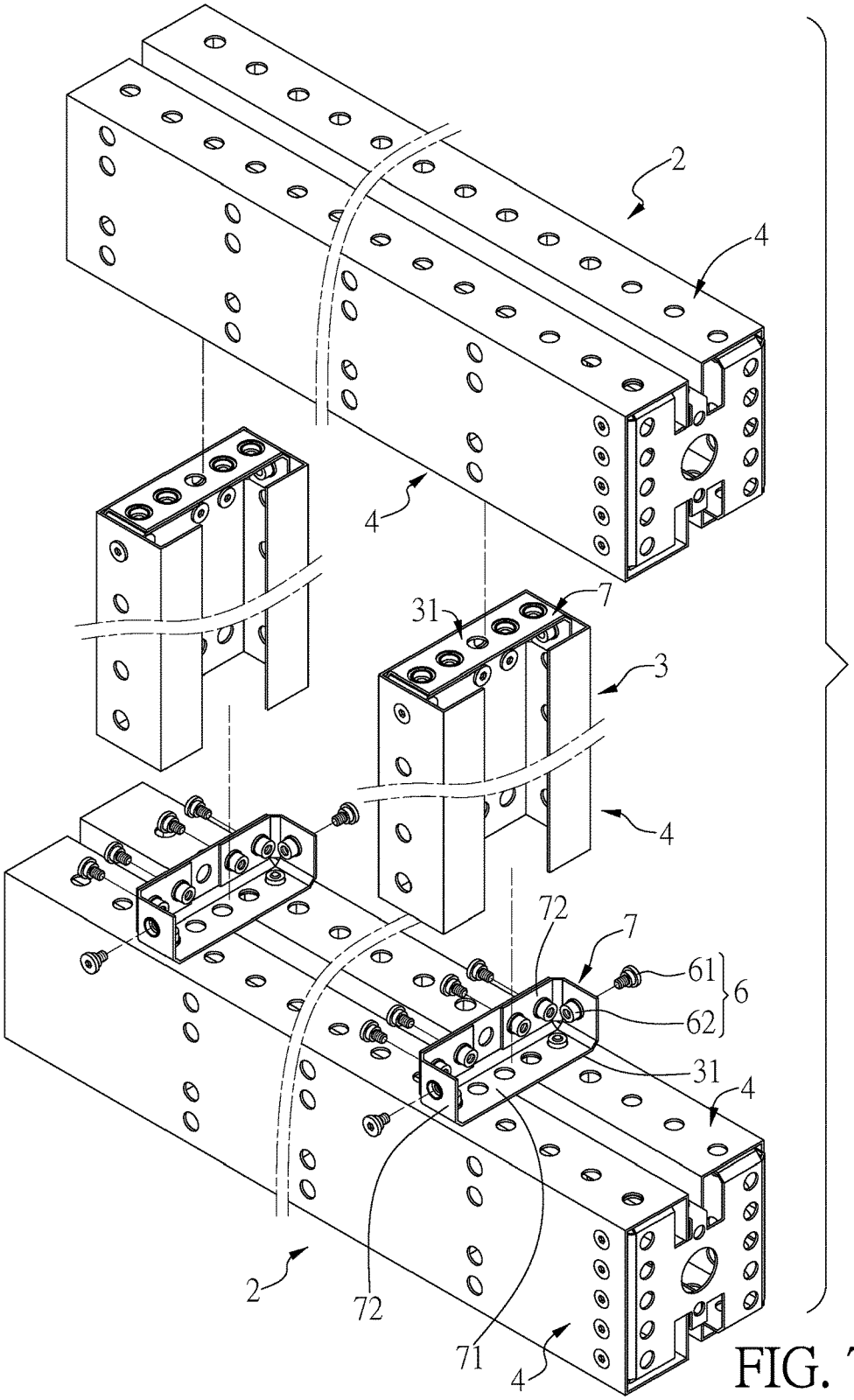
FIG. 7 illustrates a schematic exploded view showing the rafters are to be assembled with the beams to form a supporting backbone of a wall surface of the building according to the present invention.

When the assembling of the crossbeams 11 and the columns 12 of the building 1 is completed, the supporting frame of the floor surface 13, the wall surface 14, and the roof 15 of the building 1 can be assembled by the rafters 3. Taking the wall surface 14 as an example, as shown in FIG. 7, the assembling points 31 of the second positioning members 7 at the two ends of the rafter 3 are attached to the C-shaped steels 4 of the beam 2, and the second positioning members 7 of the rafter 3 and the C-shaped steels 4 of the beam 2 are locked with each other by locking members 6. Then, the two ends of the C-shaped steel 4 of the rafter 3 are locked with the second sidewalls 72 of the second positioning member 7 by locking members 6. Accordingly, a supporting frame of the wall surface 14 can be formed by several rafters 3, and subsequent plate sealing procedures can be performed on the supporting frame of the wall surface 14 to form the wall surface 14 of the building 1. Similarly, the supporting frame of the floor surface 13 and the roof 15 of building 1 can be assembled by rafters 3.

Figure 8:
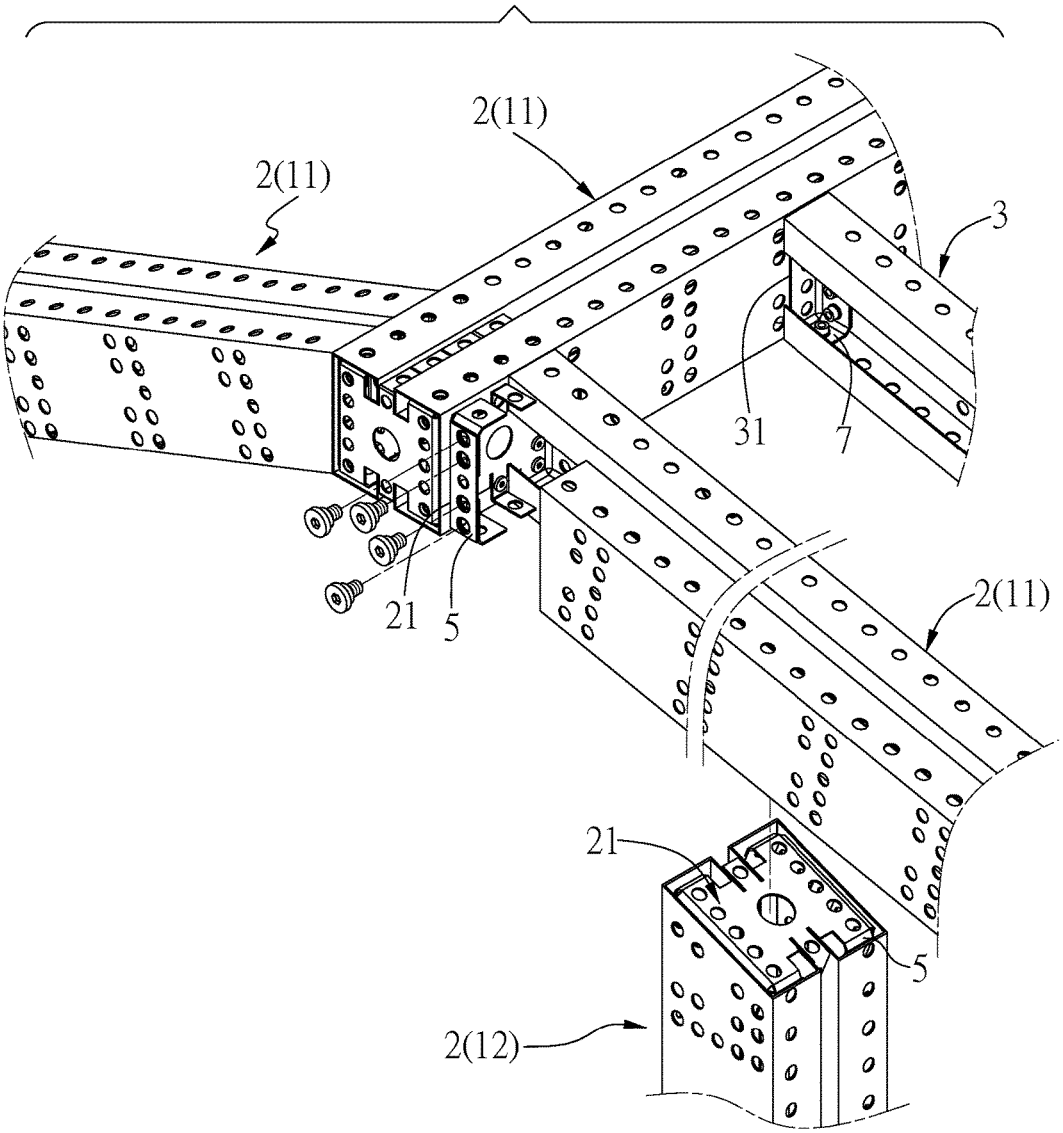
FIG. 8 illustrates a schematic exploded view showing the rafters are to be assembled with the beams to form a roof of the building according to the present invention.

When the roof of the building 1 has an inclined surface, as shown in FIG. 8, the end surface of the beam 2 and that of the rafter 3 assembled to two sides of the column 12 of the roof as well as the end surface of the beam 2 for supporting the roof can be cut to have an inclined plane for mating with the inclined surface of the roof. Therefore, the roof with an inclined surface can be assembled by the beams 2 and the rafters 3 via the combining points 21 formed on the first positioning members 5 and the assembling points 31 formed on the second positioning members 7. Accordingly, additional components are not required in constructing the roof. Hence, the assembling of the building 1 can be convenient.

Based on above, in the present invention, two ends of the C-shaped steels are positioned with the positioning members to form crossbeams, columns, or rafters. Then, any two of the aforementioned components are further connected with each other by the positioning members. Therefore, the C-shaped steels can be formed as the backbone of a lightweight steel building by locking in a fast and convenient manner.

Moreover, in the present invention, the C-shaped steels are assembled with the first and second positioning members to form the crossbeams, the columns, and the rafters of the building, and then the crossbeams, the columns, and the rafters are assembled with each other by the first and second positioning members. Therefore, builders can calculate the number and the size of the C-shaped steels as well as the number of the first positioning members and that of the second positioning members by computer software in advance. Therefore, the components for constructing the building can be manufactured in the factory by a one-time process and then the components are transported to the construction site. Accordingly, the procedures of the construction at the construction site can be simplified to improve the assembling efficiency of the building.

Furthermore, because the first positioning members and the second positioning members are positioned on the end surfaces of the two ends of the crossbeam (or that of the column or that of the rafter), the angle of the end surface of the crossbeam (or the column or the rafter) can be changed for assembling the roof or the eaves having an inclined surface without additional components. Therefore, the assembling of the building can be convenient.

Besides, the two C-shaped steels are combined with each other to form a beam in rectangular tubular shaped by the first positioning members, and the first positioning member has the wire hole. Therefore, the cables or wires can be inserted into the interior of the beam and protected by the C-shaped steels. In addition, the separation gap between the two C-shaped steels of the beam can be provided for ventilation and heat insulation.

What is claimed is:

1. A lightweight steel construction, comprising:

at least two first positioning members respectively positioned on two ends of two opposite C-shaped steels in a length direction of the C-shaped steels to form a beam in rectangular tubular shaped, the first positioning members respectively form combination points on two end surfaces of the beam, several beams are combined with each other via the combination points and formed as crossbeams and columns of a building;

at least two second positioning members respectively positioned on two ends of a C-shaped steel in the length direction of the C-shaped steel to form a rafter, the second positioning members respectively form assembling points on two end surfaces of the rafter, several rafters are positioned between adjacent beams via the assembling points and formed as a floor surface, a wall surface, and a roof of the building;

wherein two opposite first sidewalls of the first sidewalls of the first positioning member respectively have a notch and a baffle plate between the notches, the notches are for the insertion of the flanges of the C-shaped steel of the beam, the baffle plate is for the limitation the flanges of the C-shaped steels of the beam, so that two separation gaps are respectively formed on two opposite sides of the beam.

2. The lightweight steel construction according to claim 1, wherein each of the C-shaped steels of the beam has a front plate, two side plates at two sides of the front plate, and two flanges respectively extending toward each other from free sides of the side plates, an opening is formed between the two flanges, each of the first positioning members has a first bottom surface and first sidewalls respectively extending from four edges of the first bottom surface in a same direction, the first sidewalls of the first positioning members are locked with the front plates and the corresponding side plates of the C-shaped steels to form the beam by locking members, the first bottom surfaces of the first positioning members are respectively located on the end surfaces of the beam to than the combination points, so that the several beams are combined with each other via locking members and formed as the crossbeams and columns of the building.

3. The lightweight steel construction according to claim 2, wherein a wire hole is on a center of the first bottom surface of the first positioning member.

4. The lightweight steel construction according to claim 2, wherein each of the locking members comprises an insert nut and a bolt, the front plate and the side plates of the C-shaped steel of the beam and the first bottom surface and the first sidewalls of the first positioning member respectively have holes, positions of the holes of the C-shaped steel of the beam corresponds to positions of the holes of the first positioning member, the holes are for positioning the insert nuts and inserting the bolts.

5. The lightweight steel construction according to claim 1, wherein the C-shaped steel of the rafter has a front plate, two side plates at two sides of the front plate, and two flanges respectively extending toward each other from free sides of the side plates, an opening is formed between the two flanges for disposing the second positioning member, each of the second positioning members has a second bottom surface and second sidewalls respectively extending from three connected edges of the second bottom surface in a same direction, the second sidewalls of the second positioning member are locked with the front plate and the side plates of the C-shaped steel to form the rafter by locking members, the second bottom surfaces of the second positioning members are respectively located on the end surfaces of the rafter to form the assembling points, the second bottom surface has several through holes, so that two ends of each of the rafters are assembled between adjacent beams via the through holes and the locking members, and the rafters are formed as the floor surface, the wall surface, and the roof of the building.

6. The lightweight steel construction according to claim 5, wherein each of the locking members comprises an insert nut and a bolt, the front plate and the side plates of the C-shaped steel of the rafter and the second bottom surface and the second sidewalls of the second positioning member respectively have holes, positions of the holes of the C-shaped steel of the rafter corresponds to positions of the holes of the second positioning member, the holes are for positioning the insert nuts and inserting the bolts.

* * * * *